US007250835B2

(12) United States Patent
Higgins et al.

(10) Patent No.: US 7,250,835 B2
(45) Date of Patent: Jul. 31, 2007

(54) WAVEGUIDE BAND-STOP FILTER

(75) Inventors: John A. Higgins, Westlake Village, CA (US); Hao Xin, Tucson, AZ (US)

(73) Assignee: Teledyne Licensing, LLC, Thousand Oaks, CA (US)

( * ) Notice: Subject to any disclaimer, the term of this patent is extended or adjusted under 35 U.S.C. 154(b) by 8 days.

(21) Appl. No.: 10/874,667

(22) Filed: Jun. 22, 2004

(65) Prior Publication Data

US 2005/0184833 A1 Aug. 25, 2005

Related U.S. Application Data

(60) Provisional application No. 60/546,502, filed on Feb. 20, 2004.

(51) Int. Cl.
*H01P 1/207* (2006.01)
*H01P 1/20* (2006.01)

(52) U.S. Cl. ..... 333/208; 333/209

(58) Field of Classification Search ..... 333/208, 333/209, 219, 235; 343/909
See application file for complete search history.

(56) References Cited

U.S. PATENT DOCUMENTS 3,886,497 A 5/1975 Helszajn
4,058,780 A 11/1977 Riblet
4,124,830 A 11/1978 Ren
4,321,568 A * 3/1982 Joyal et al. ..... 333/209
6,262,495 B1 7/2001 Yablonovitch et al.
6,392,508 B1 5/2002 Damphousse et al.
6,483,480 B1 11/2002 Sievenpiper et al.

OTHER PUBLICATIONS

Higgins et al., (Characteristics of Ka Band Waveguide Electromagnetic Crystal Sidewalls), 2002, IEEE MTT-S Digest pp. 1071-1074.*

Diaz et al, Broadband Antennas Over Electronically Reconfigurable Artificial Magnetic Conductor Surfaces, 2001 Antenna Applications Symposium, Monticello, IL, Sep. 19-21, 2001.

Xin et al, Electromagnetic Crystal (EMXT) Waveguide BAnd-Stop Filter, 2003 IEEE Microwave and Wireless Components Letters, vol. 13, No. 3, Mar. 2003.

* cited by examiner

*Primary Examiner*—Stephen E. Jones
(74) *Attorney, Agent, or Firm*—Koppel, Patrick, Heybl & Dawson

(57) ABSTRACT

A filter includes a waveguide with at least one impedance structure with a resonant frequency. The impedance structure is positioned in the waveguide to reflect signals at the resonant frequency. The filter can be tunable by including variable capacitance devices in the impedance structure(s) so that the resonant frequency can be adjusted.

22 Claims, 4 Drawing Sheets

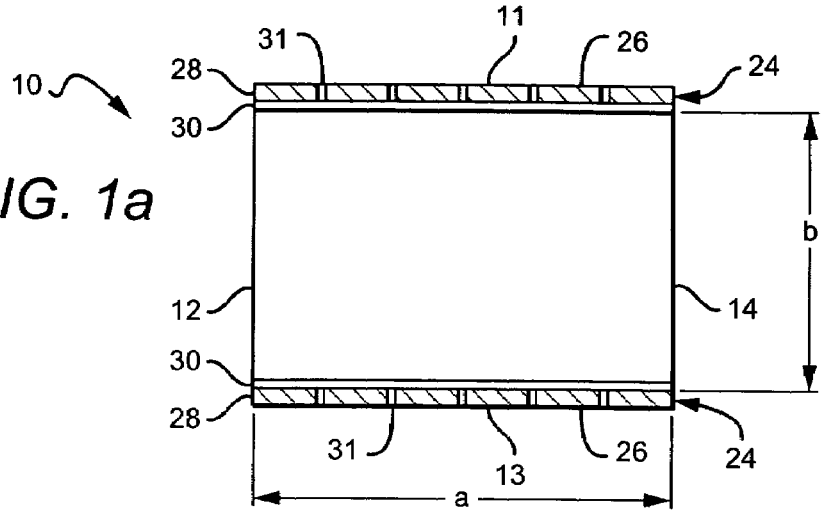
FIG. 1a
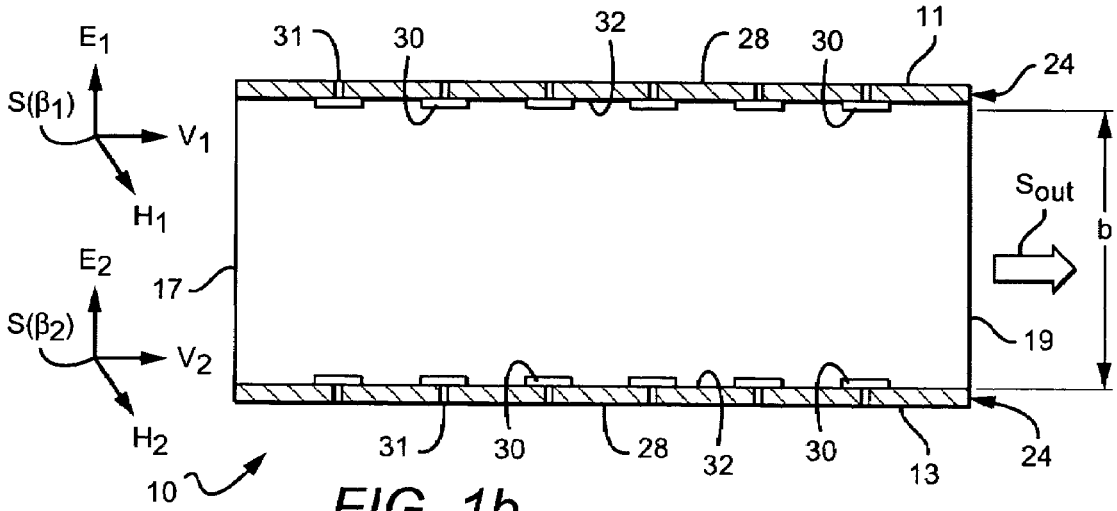
FIG. 1b
FIG. 1c
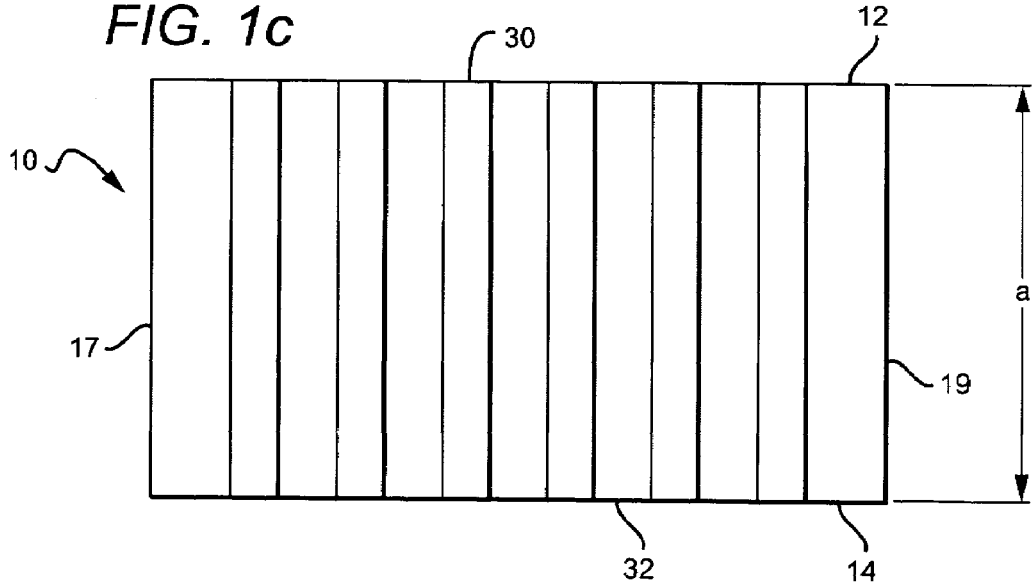

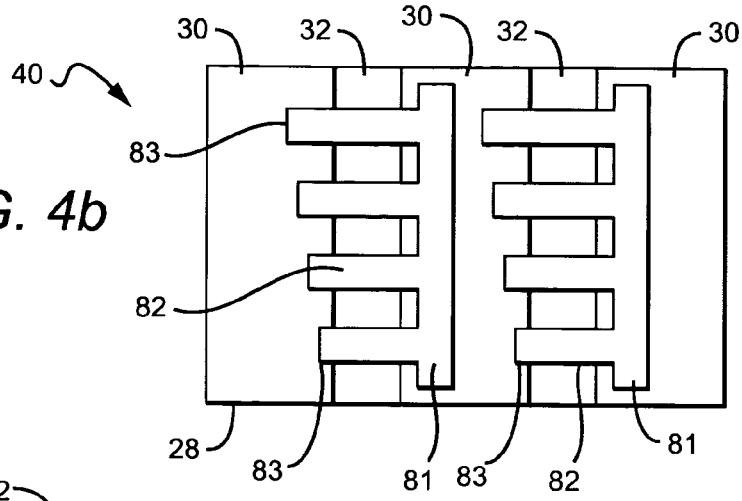
FIG. 4b
FIG. 5
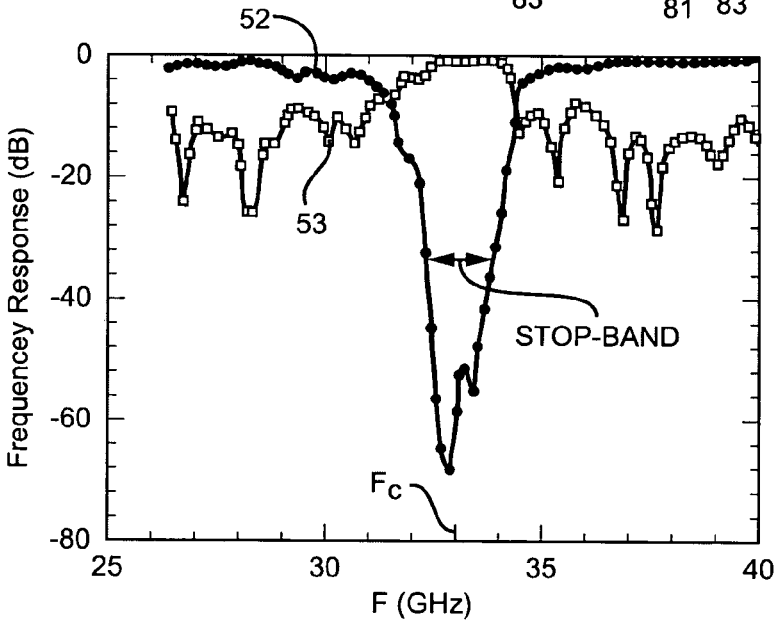
FIG. 6
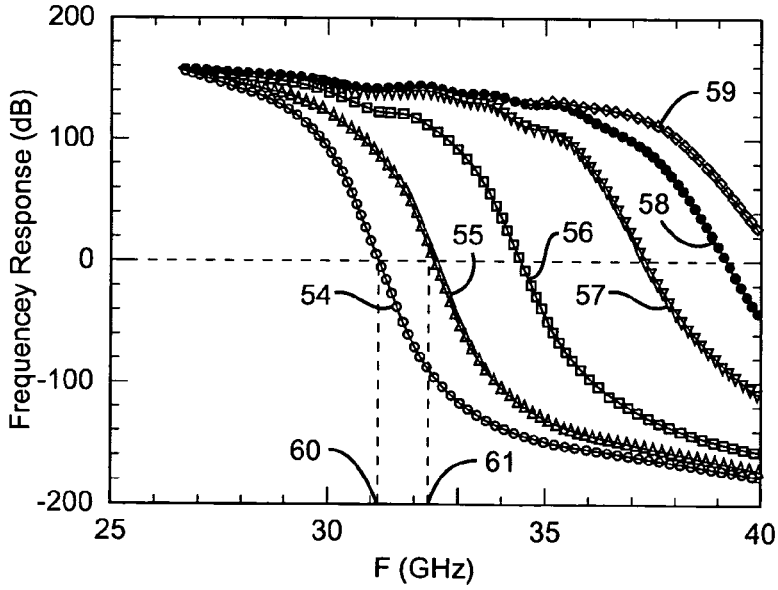

WAVEGUIDE BAND-STOP FILTER

CROSS REFERENCES TO RELATED APPLICATIONS

This application claims the benefit of U.S. Provisional Application Ser. No. 60/546,502, filed on Feb. 20, 2004.

BACKGROUND OF THE INVENTION

1. Field of the Invention

This invention relates generally to waveguides and, more particularly, to waveguide filters.

2. Description of the Related Art

Electromagnetic signals with wavelengths in the millimeter range are typically guided to a destination by a waveguide because of insertion loss considerations. An example of one such waveguide can be found in U.S. Pat. Nos. 6,603,357 and 6,628,242 which disclose waveguides with electromagnetic crystal (EMXT) surfaces. The EMXT surfaces allow for the transmission of high frequency signals with near uniform power density across the waveguide cross-section. More information on EMXT surfaces can be found in U.S. Pat. Nos. 6,262,495 and 6,483,480.

In some waveguide systems, filters are used to control the flow of signals during transmission and reception. The filters are chosen to provide low insertion loss in the selected frequency bands and high power transmission with little or no distortion. A band-stop filter can be used to block undesired signals from reaching the receiver or from being transmitted. The filter can be tuned to a different resonant frequency using mechanical adjustments such as tuning screws as disclosed in U.S. Pat. No. 5,471,164 or movable dielectric inserts as disclosed in U.S. Pat. No. 4,124,830. The screw and insert can be mechanically adjusted to change the length of a resonant cavity in the filter. The tuning occurs because the resonant frequency of the filter changes when the length is varied. Mechanical tuning, however, is slow and inaccurate because it is usually done manually. If the mechanical adjustment cannot tune the resonant frequency quickly enough, then the filter will not effectively block signals with frequencies that vary as a function of time.

SUMMARY OF THE INVENTION

The present invention provides a filter which includes one or more impedance structures positioned in a waveguide. The structures attenuate a signal at the resonant frequency of the impedance structure and transmit signals outside the stop-band. In one embodiment, the resonant frequency and stop-band can be tuned to provide a desired filter frequency response. The filter can be included in a communication system to block signals at undesired frequencies from reaching the system. The filter can also be included in or coupled to a waveguide circulator to provide frequency selective communications.

These and other features, aspects, and advantages of the present invention will become better understood with reference to the following drawings, description, and claims.

BRIEF DESCRIPTION OF THE DRAWINGS

FIGS. 1*a*, 1*b*, and 1*c* are front, side, and top elevation views, respectively, of a band-stop waveguide filter with impedance structures;

FIGS. 4*a* and 4*b* are simplified side and top views, respectively, of tunable impedance structures which include variable capacitance micro-electromechanical devices;

FIG. 5 is graph of the frequency response (dB) verses the operating frequency F (GHz) for the filter of FIG. 1 with one impedance structure an a sidewall;

FIG. 6 is a graph of the reflection phase (degrees) verses the operating frequency F (GHz) for the filter of FIG. 1 with the impedance structure of FIG. 3 which include variable capacitors;

DETAILED DESCRIPTION OF THE INVENTION

Figure 2:
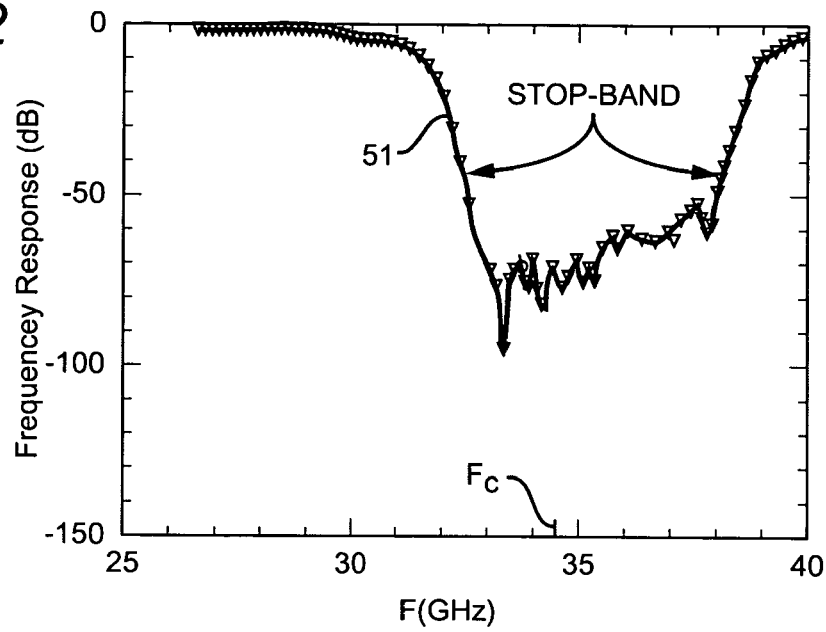
FIG. 2 is a graph of the frequency response (dB) verses the operating frequency F (GHz) of the filter of FIG. 1 with a pair of impedance structures.

FIGS. 1*a*, 1*b*, and 1*c* show front, side, and top elevation views, respectively, of a waveguide filter 10 which includes tunable impedance structures 24 that operate as an electromagnetic crystal (EMXT) structure. Impedance structures 24 are positioned on opposed sidewalls 11 and 13 and extend between ends 17 and 19. The other waveguide sidewalls 12 and 14 are spaced apart by a width a (See FIG. 1*b*) and sidewalls 11 and 13 are spaced apart by a height b (See FIG. 1*c*) so that filter 10 has a rectangular cross-section. The cross-sectional shape of filter 10 typically depends on the polarization of the signal propagated through the filter, so it can have a cross-section other than rectangular. For example, the cross-section can be circular for a coaxial waveguide structure which guides circularly polarized signals. The impedance structures in this case can be positioned 180° from one another.

Structures 24 include a dielectric substrate 28 that has a conductive region 26 positioned over its exterior. Region 26 can form a portion of corresponding sidewalls 11 or 13 and can operate as a ground plane. Conductive strips 30 are positioned over the interior of substrate 28 and are separated from each adjacent strip by a gap 32. Conductive strips 30 are parallel to one another and extend perpendicular to the filter's longitudinal axis.

Conductive vias 31 extend from strips 30, through substrate 28 to conductive region 26. Vias 31 and gaps 32 reduce substrate wave modes and surface current flow, respectively, through substrate 28 and between adjacent strips 30. The width of strips 30 present an inductive reactance L to the transverse E field and gaps 32 present an approximately equal capacitive reactance C.

Numerous materials can be used to construct impedance structure 24. Dielectric substrate 28 can be made of many dielectric materials including plastics, poly-vinyl carbonate (PVC), ceramics, or semiconductor material, such as indium phosphide (InP) or gallium arsenide (GaAs). Highly conductive material, such as gold (Au), silver (Ag), or platinum (Pt), can be used for conductive strips 30, conductive layer 26, and vias 31 to reduce any series resistance.

Structure 24 can provide a desired surface impedance in a band of frequencies around its resonant frequency $F_{res}$, with one such band being the Ka-Band. The impedance and resonant frequency of structures 24 depend on its geometry and material properties, such as the thickness, permittivity, and permeability of substrate 28, the area of conductive strips 30, the inductance of vias 31, and the width of gap 32.

For an incoming electromagnetic wave at operating frequency F and with the E-field polarization perpendicular to conductive strips 30 and substrate 28, structure 24 exhibits a high surface impedance at $F_{res}$. Since conductive strips 30 are oriented perpendicular to the signal's direction of travel, they attenuate longitudinal surface currents at $F_{res}$. This attenuation causes frequencies within a stop-band around $F_{res}$ to be reflected so that filter 10 behaves as a band-stop filter. For operating frequencies outside the stop-band, the signals are transmitted because the impedance of structures 24 is low so that surface currents from these signals can flow longitudinally.

Hence, in its highest impedance state, little or no surface currents can flow in the direction of the signal and, consequently, tangential H fields along strips 30 are zero. At frequencies outside the stop-band, structures 24 has a small impedance which allows time varying surface current to flow and the corresponding signals to propagate through filter 10.

The propagation constant β of the incoming electromagnetic wave is related to the waveguide wavelength $\lambda_g$ through the well-known equation $\beta=2\pi/\lambda_g$. Wavelength $\lambda_g$ is related to the operating frequency F by the equation $\lambda_g=\lambda_o/\sqrt{(1-(\lambda_o/2a)^2}$ in which $\lambda_o=c/F$ where $\lambda_o$ is the free space wavelength and c is the speed of light. Because the impedance of structure 24 determines which β value of the incoming signal will resonate with structure 24, filter 10 can selectively transmit some signal frequencies and reflect others. The signals are represented by an electromagnetic wave with an electric field E, a magnetic field H, and a velocity v (See FIG. 1*b*). For example, $S_{out}$ will equal $S(\beta_1)$ or $S(\beta_2)$ if the resonant frequency of structures 24 is chosen to resonate with signals $S(\beta_2)$ or $S(\beta_1)$, respectively.

FIG. 2 shows the frequency response of filter 10 verses operating frequency F (GHz). Filter 10 has a stop-band with a bandwidth extending from about 31 GHz to 40 GHz, with a center frequency $F_c$ at about 35 GHz. The frequency response is attenuated by about 80 dB in the stop-band. Outside of the stop-band, the attenuation of the signal is less than about 2 dB. This loss can be attributed to the dielectric loss of substrate 28. Hence, signals with frequencies within the stop-band will be reflected by filter 10 and signals with frequencies outside the stop-band will be transmitted with little or no loss.

Figure 3:
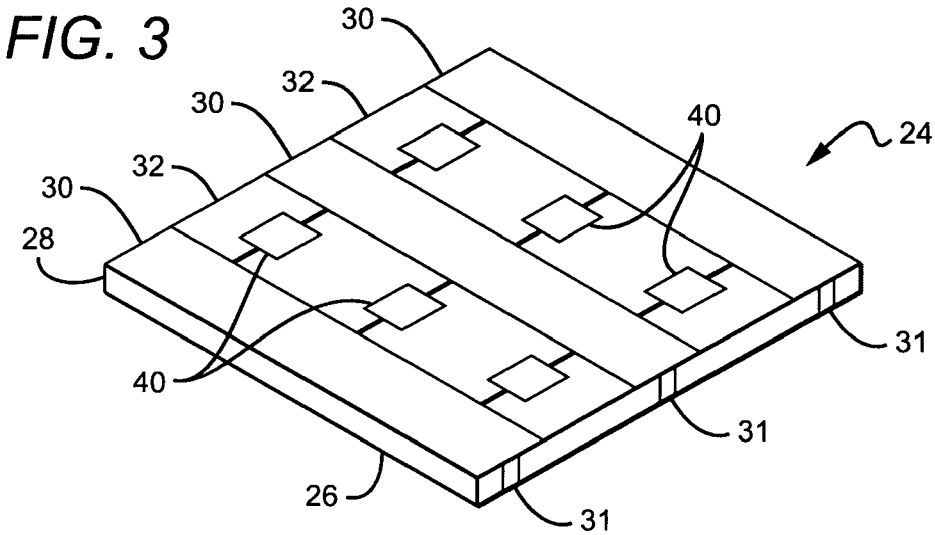
FIG. 3 is a simplified perspective view of a tunable impedance structure with variable capacitance devices.

FIG. 3 shows a more detailed view of impedance structures 24 which include variable capacitance devices 40 so that the resonance frequency $F_{res}$ of structures 24 can be tuned. Variable capacitance devices 40 are coupled between adjacent conductive strips 30 to allow the capacitance between them to be adjusted to vary $F_{res}$. Also, the losses associated with the series resistance of devices 40 near $F_{res}$ enhance the band rejection of the filter by decreasing the return loss.

Devices 40 can include varactors, MOSFETs, or micro-electromechanical (MEMS) devices, among other devices with variable capacitances. The varactors can include InP heterobarrier varactors or another type of varactor embedded in impedance structure 24. A MOSFET can also be used as an alternative by connecting its source and drain together so that it behaves as a two terminal device. In any of these examples, the capacitance of devices 40 can be controlled by devices and/or circuitry embedded in filter 10 or positioned externally.

In the operation of structure 24 in FIG. 3, a voltage is applied across devices 40 through strips 30 to control their capacitances. The capacitance between adjacent conductive strips 30 is in parallel with the capacitance of devices 40. Hence, if the voltage applied across devices 40 increases, then its capacitance decreases along with the total capacitance. In this case, structure 24 resonates at a higher frequency. If the voltage across devices 40 decreases, then its capacitance increases along with the total capacitance. In this case, structure 24 resonates at a lower frequency. In this way, $F_{res}$ and the stop-band can be tuned.

Figure 4A:
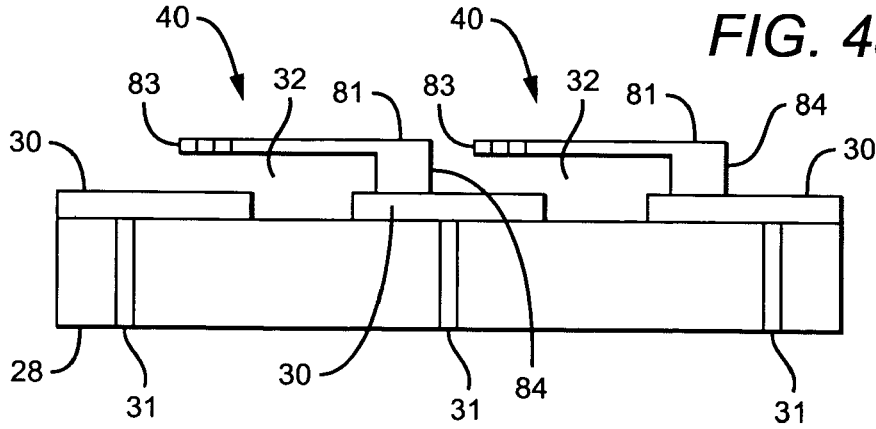

FIGS. 4*a* and 4*b* are simplified side and top views, respectively, of impedance structure 24 with devices 40 which include micro-electromechanical (MEMS) devices 81. Each device 81 includes a base structure 84 connected to one conductive strip 30. Multiple magnetic fingers 82 extend from base structure 84 to an adjacent conductive strip. The magnetic structure of each device 81 is chosen so that the distance between an end 83 of finger 82 and the corresponding adjacent strip 30 can be changed by applying a magnetic field.

The magnetic field then controls the capacitance between adjacent conductive strips 30 by controlling how much fingers 82 bend. As the distance between fingers 82 and the adjacent strip decreases, the capacitance increases. The capacitance also increases as the overlap between end 83 and conductive strip 30 increases. Multiple fingers are included in each device 81 to control the linearity of the capacitance as a function of the applied magnetic field. The capacitance is more linear as the number of fingers increases. These relationships are given by the well-known equation $C=\epsilon_1 A/d$, in which $\epsilon_1$ is the permittivity, A is the overlap area, and d is the distance, all between end 83 and strip 30. Thus, the change in capacitance of MEMS devices 81 can be used to tune $F_{res}$ and the stop-band as described above in conjunction with FIG. 3.

FIG. 5 shows a graph of the frequency response (dB) of filter 10 verses operating frequency F (GHz) when filter 10 includes structure 24 positioned only on surface 11 or 13 instead of on both. Shown are the return loss (Curve 52) and the insertion loss (Curve 53) of filter 10. The center frequency $F_c$ of the stop-band is lower and the bandwidth is narrower compared to FIG. 2. This indicates that the bandwidth of the stop-band can be reduced by including only one impedance structure 24 instead of two as shown in FIG. 1.

If two impedance structures are included as shown in FIG. 1, however, the bandwidth can still be controlled. This is done by making the impedance of one structure high at $F_{res}$ while making the impedance of the other structure low so that it behaves like a metallic surface. The frequency response will be similar to that shown in FIG. 5. Hence, the bandwidth of the stop-band can also be actively varied by independently tuning the impedance structures.

FIG. 6 shows the reflection phase (degrees) of waveguide filter 10 with structures 24 as shown in FIG. 3 as a function of operating frequency F (GHz). The curves are for biases of 0 volts (curve 54), 1 volt (curve 55), 2 volts (curve 56), 4 volts (curve 57), 6 volts (curve 58), and 8 volts (curve 59). $F_{res}$ occurs where the phase is equal to 0 degrees. Hence, FIG. 6 shows that each curve is at zero degrees at different frequencies indicating that the bias can be used to adjust $F_{res}$. For example, curve 54 is at zero degrees at about 31.2 GHz (point 60) and curve 55 is at zero degrees at about 33.4 GHz (point 61). Hence, with structures 24 on surfaces 11 and 13 individually controlled by separate biases, both $F_c$ and the bandwidth of the stop-band can be adjusted.

Figure 7A:
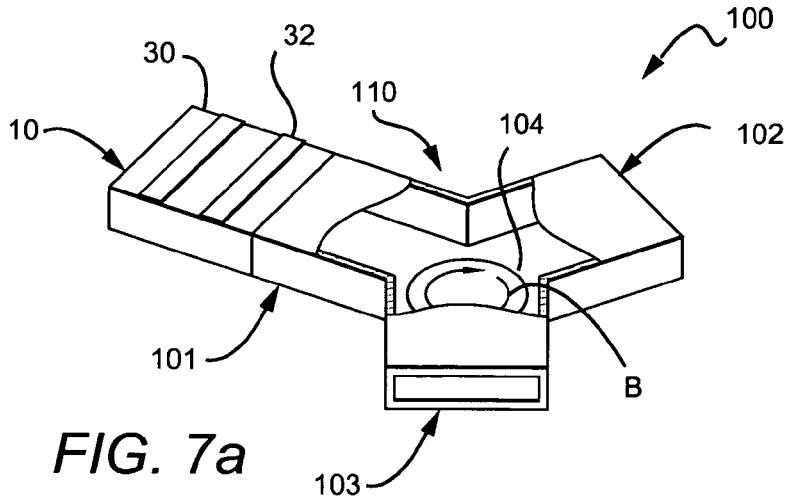
FIGS. 7*a* and 7*b* are simplified perspective and top views, respectively, of a frequency selective filter which includes a waveguide circulator coupled to the waveguide filter of FIG. 1.
Figure 7B:
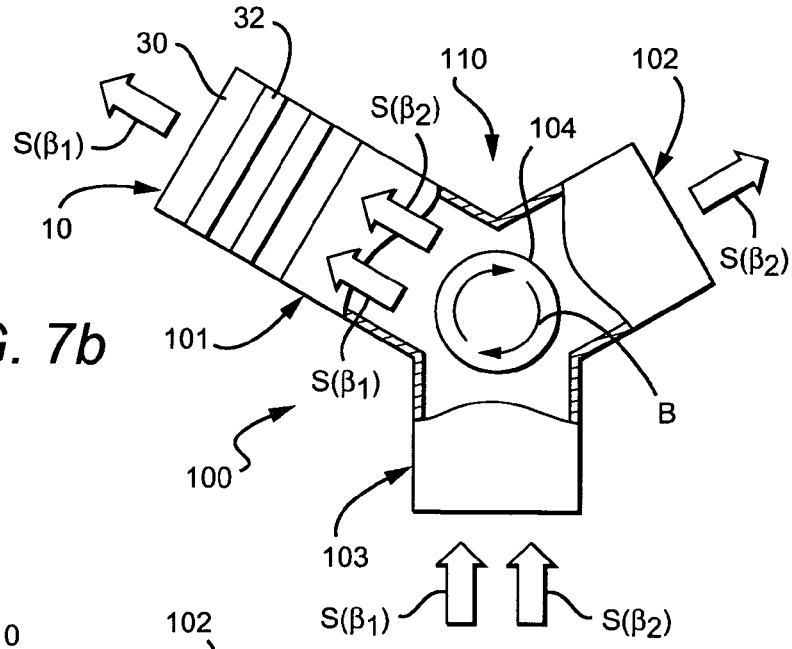

FIGS. 7*a* and 7*b* show a frequency selective filter 100 which includes a waveguide circulator 110 with input port 103 and output ports 101 and 102. Ports 101, 102, and 103 are at angles of about 120° and operate as a Y-junction. Port 101 is coupled to waveguide filter 10 and a gyromagnetic device 104 is coupled to the Y-junction. Device 104 selectively transmits signals through the Y-junction by providing a rotating magnetic field B which directs the signals flowing through port 103 to the output ports. The particular output port that the signal is directed to depends on the rotation of B.

In an,example, signals $S(\beta_1)$ and $S(\beta_2)$ are input to port 103 so that gyromagnetic device 104 directs them towards port 101 and filter 10 by using a clock-wise rotating magnetic field B. If filter 10 is tuned to block signal $S(\beta_2)$, then $S(\beta_1)$ will be outputted through port filter 10 and signal $S(\beta_2)$ will be reflected back towards device 104. Device 104 will then direct signal $S(\beta_2)$ towards port 102 where it is outputted. Hence, filter 100 provides frequency selective transmissions of signals $S(\beta_1)$ and $S(\beta_2)$.

Figure 8:
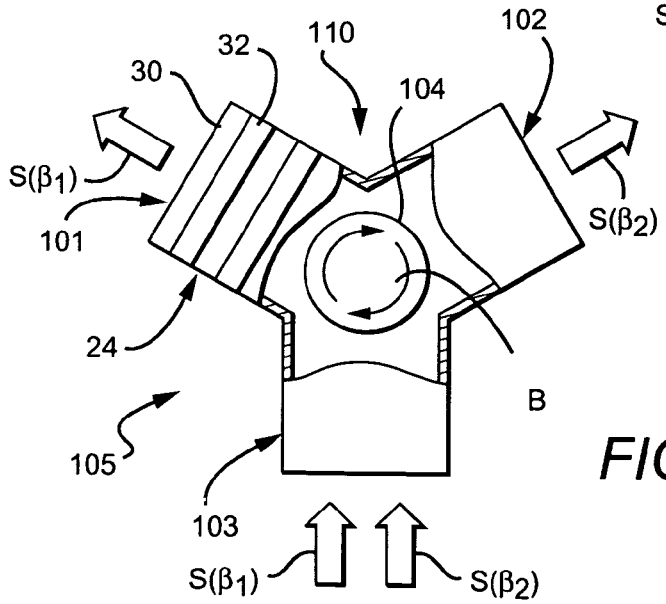
FIG. 8 is a simplified top view of a frequency selective filter which includes a waveguide circulator with the impedance structures of FIG. 4 integrated into an output port.

FIG. 8 shows another example of a frequency selective filter 105 which operates the same way as filter 100. In filter 105, however, impedance structures 24 are integrated with port 101. Some advantages are that fewer components are needed and the filter is more compact.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A filter, comprising:

a rectangular waveguide having two sidewalls and top and bottom walls and a longitudinal axis that runs along the length of said waveguide, said top and bottom walls being those which carry longitudinal currents that support power flow through the waveguide which are induced by a signal passing through said waveguide; and at least one impedance structure having an associated resonant frequency mounted to at least one of the top and bottom walls of said waveguide, said at least one impedance structure comprising electromagnetic crystal (EXMT) fabricated perpendicular to the filter's longitudinal axis so as to inhibit the flow of said longitudinal currents such that said filter reflects signals within a stop-band centered at said resonant frequency.

2. The filter of claim 1, wherein the impedance of said impedance structure is adjustable to adjust said resonant frequency.

3. The filter of claim 1, wherein the impedance of said impedance structure is adjustable to adjust the bandwidth of the stop-band.

4. The filter of claim 1, wherein said impedance structure includes one or more variable capacitance devices with capacitances that can be adjusted to tune said resonant frequency.

5. The filter of claim 4, wherein a series resistance of each variable capacitance device is chosen to obtain a desired attenuation of said signals in said stop-band.

6. The filter of claim 1, wherein said at least one impedance structure provides said filter with a desired frequency response.

7. The filter of claim 6, wherein said impedance structures are adjustable to adjust their resonant frequency to establish said desired frequency response.

8. The filter of claim 1, wherein said at least one impedance structure comprises at least first and second impedance structures positioned on said top and bottom walls of said waveguide.

9. The filter of claim 8, wherein said first and second impedance structures can be independently tuned to adjust a frequency response of said filter.

10. The filter of claim 8, wherein said first and second impedance structures can be independently tuned to adjust the bandwidth of said stop-band.

11. The filter of claim 1, wherein said at least one impedance structure reflects signals in said stop-band.

12. The filter of claim 11, wherein said impedance structures are adjustable to adjust the bandwidth of said stop-band.

13. The filter of claim 11, wherein said impedance structures are adjustable to adjust a propagation constant of said signals so that they resonate with a resonant frequency of said impedance structures.

14. The module of claim 1, wherein said impedance structures include:

a substrate of dielectric material having two sides;

a conductive layer on one side of said dielectric material;

a plurality of mutually spaced conductive strips on the other side of said dielectric material, said strips being separated by gaps and positioned perpendicular to said waveguide's longitudinal axis;

at least one variable capacitance device across each said gap; and at least one conductive via which provides an inductance between said conductive layer and said conductive strips.

15. The module of claim 6, wherein each variable capacitance device is adjustable to adjust a resonant frequency of a corresponding impedance structure.

16. The module of claim 14, wherein each variable capacitance device is adjustable to adjust the propagation constant of said signals.

17. The filter of claim 1, wherein said at least one impedance structure comprises a periodic pattern of metal strips or patches arranged such that said structures impose a high surface impedance which inhibits the flow of surface currents on the surfaces to which said structures are mounted.

18. The filter of claim 17, wherein said metal strips are EXMT strips.

19. The filter of claim 17, wherein said at least one impedance structure includes tunable capacitance devices connected between each pair of metal strips or patches, said resonant frequency varying with said tunable capacitance.

20. The filter of claim 19, wherein said tunable capacitance devices comprise varactors.

21. The filter of claim 19, wherein said tunable capacitance devices comprise MOSFETs.

22. The filter of claim 19, wherein said tunable capacitance devices comprise micro-electromechanical (MEMS) devices.

* * * * *